US008186815B2

(12) United States Patent
Shimizu

(10) Patent No.: US 8,186,815 B2
(45) Date of Patent: May 29, 2012

(54) LIQUID EJECTION DEVICE AND SUB TANK FOR USE WITH THE SAME

(75) Inventor: Yoichiro Shimizu, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 536 days.

(21) Appl. No.: 12/053,547

(22) Filed: Mar. 21, 2008

(65) Prior Publication Data

US 2008/0231676 A1 Sep. 25, 2008

(30) Foreign Application Priority Data

Mar. 23, 2007 (JP) ..... 2007-076658

(51) Int. Cl.
*B41J 2/175* (2006.01)

(52) U.S. Cl. ..... 347/86; 347/85

(58) Field of Classification Search ..... 347/37, 347/84–86

See application file for complete search history.

(56) References Cited

U.S. PATENT DOCUMENTS

| | | | | |
|---|---|---|---|---|
| 6,585,358 | B2 * | 7/2003 | Usui et al. | 347/85 |
| 6,702,427 | B2 | 3/2004 | Shimizu et al. | |
| 7,185,974 | B2 | 3/2007 | Katayama | |
| 2001/0020971 | A1 | 9/2001 | Usui et al. | |
| 2003/0202072 | A1 | 10/2003 | Childs et al. | |
| 2005/0057626 | A1 | 3/2005 | Usui et al. | |
| 2007/0109369 | A1 | 5/2007 | Usui et al. | |
| 2009/0167827 | A1 | 7/2009 | Usui et al. | |

FOREIGN PATENT DOCUMENTS

| | | | |
|---|---|---|---|
| JP | 2001-270129 | A | 10/2001 |
| JP | 2002307711 | A | 10/2002 |
| JP | 2003-312012 | A | 11/2003 |
| JP | 200566906 | A | 3/2005 |

OTHER PUBLICATIONS

Japan Patent Office, Notification of Reasons for Refusal for Japanese Patent Application No. 2007-076658 (counterpart to above-captioned patent application), dispatched Sep. 28, 2010.

* cited by examiner

*Primary Examiner* — Geoffrey Mruk
(74) *Attorney, Agent, or Firm* — Baker Botts L.L.P.

(57) ABSTRACT

A liquid ejection device is connectable to a main tank. The liquid ejection device includes an ejection head; and a sub tank having an inner space defined therein and including a connection portion configured to connect the inner space with the main tank. The sub tank includes a liquid inlet through which the liquid is allowed to flow from the main tank into the inner space when the main tank is connected to the connection portion; an atmosphere opening that communicates between an outside of the sub tank and the inner space; and a valve configured to selectively open and close the atmosphere opening. The valve opens the atmosphere opening in a state where the main tank is connected to the connection portion and closes the atmosphere opening in a state where the main tank is not connected to the connection portion.

16 Claims, 7 Drawing Sheets

LIQUID EJECTION DEVICE AND SUB TANK FOR USE WITH THE SAME

CROSS-REFERENCE TO RELATED APPLICATIONS

This application is based upon and claims the benefit of priority from Japanese Patent Application No. 2007-076658, filed on Mar. 23, 2007, the entire contents of which are incorporated herein by reference.

TECHNICAL FIELD

The present invention relates to a liquid ejection device connectable to a main tank and including a sub tank, and the sub tank for use with the liquid ejection device.

BACKGROUND

There is an inkjet recording device connectable to an exchangeable main tank (also referred to as an ink cartridge), and ink is supplied from an exchangeable main tank to an ejection head of the inkjet recording device. The inkjet recording device ejects ink through the ejection head to form an image on a medium such as a recording sheet or other recording media. In the inkjet recording device, when a main tank is exchanged with new one after the ink in the main tank is used up, air may enter into an ink supplying path that leads to the ejection head. As an example of an inkjet recording device for preventing entry of air into the ink supplying path, JP-A-2002-307711 and JP-A-2005-66906 discloses a sub tank interposed between the main tank and the ejection head.

In this inkjet recording device, the sub tank is open to an atmosphere and connected to the ejection head via a flexible tube, and a main tank is mounted and connected to the sub tank from above. Even if the ink in the main tank is used up, ink remains in the sub tank. Therefore, the entry of air into the tube leading to the ejection head can be prevented. Also, although air may enter into a connection portion between the main tank and the sub tank during exchange of the main tank, since the sub tank is open to the atmosphere, the entered air moves along with the ink into sub tank and thereafter is separated from the ink due to its buoyancy and then discharged to the exterior. Accordingly, entry of the air into the tube can be prevented.

SUMMARY

Recently, there are demands for a small-sized and planarized inkjet recording devices. As one example of a design to meet the demand, the arrangement disclosed in the above patent documents may be applied so that a connection portion to connect with the main tank (to be more accurate, an inlet of the ink from the main tank) is disposed at a side wall of the sub tank, thereby the main tank is connected to the sub tank from a lateral direction. However, since the sub tank is open to the atmosphere as mentioned above, when the main tank is detached from the sub tank containing residual ink, the residual ink may leak out to the outside via the ink inlet of the sub tank.

In particular, in case where the main tank is disposed lateral to the sub tank, in order to reduce the ink amount remaining in the main tank after supplying of the ink from the main tank to the sub tank as much as possible and adequately exhibit the gas-liquid separation function of the sub tank, the ink inlet is preferably positioned as low as possible at the side wall of the sub tank. However, positioning the ink outlet at the lower position increases the possibility of the ink leaking out upon detachment of the main tank even when the sub tank has small amount of the remaining ink.

Such a circumstance is not restricted to inkjet recording devices for forming images by ejecting ink onto a recording sheet but applies in common to liquid ejection devices including a sub tank for gas-liquid separation between a detachable main tank and an ejection head that ejects liquid droplets.

An object of one aspect of the present invention is to provide a liquid ejection device that includes a sub tank for gas-liquid separation between a detachable main tank and an ejection head and can prevent liquid from leaking out from the sub tank in a state where the main tank and the sub tank are not connected, and to provide the sub tank for use with the liquid ejection device.

According to an aspect of the invention, there is provided a liquid ejection device connectable to a main tank configured to store a liquid, said liquid ejection device comprising: an ejection head configured to eject a liquid to a medium; and a sub tank having an inner space defined therein and including a connection portion configured to connect the inner space with the main tank, the sub tank configured to supply the liquid from the main tank to the ejection head; wherein the sub tank comprises: a liquid inlet through which the liquid is allowed to flow from the main tank into the inner space when the main tank is connected to the connection portion; an atmosphere opening that communicates between an outside of the sub tank and the inner space; and a valve configured to selectively open and close the atmosphere opening, and wherein the valve opens the atmosphere opening in a state where the main tank is connected to the connection portion and closes the atmosphere opening in a state where the main tank is not connected to the connection portion.

According to another aspect of the invention, there is provided a sub tank for use with a liquid ejection device comprising an ejection head and connectable to a main tank to supply the liquid contained in the main tank to the liquid ejection device, said sub tank comprising: an inner space defined in the sub tank; a connection portion configured to connect the inner space with the main tank; a liquid inlet through which the liquid is allowed to flow from the main tank into the inner space when the main tank is connected to the connection portion; an atmosphere opening that communicates between an outside of the sub tank and the inner space; and a valve configured to selectively open and close the atmosphere opening, wherein the valve opens the atmosphere opening in a state where the main tank is connected to the connection portion and closes the atmosphere opening in a state where the main tank is not connected to the connection portion.

BRIEF DESCRIPTION OF THE DRAWINGS

FIGS. 4A and 4B are diagrams for describing a function of preventing ink leakage from the sub tank, in which FIG. 4A shows the main tank slightly separated from the sub tank, and FIG. 4B shows the two components completely separated;

FIGS. 7A and 7B are diagrams for describing functions of the sub tank, in which FIG. 7A shows the main tank mounted to a main tank mounting portion and menisci formed at a connection portion of the main tank and the sub tank, and FIG. 7B shows the menisci having been broken.

DESCRIPTION

A liquid ejection device according to embodiments of the present invention and a sub tank for with the liquid ejection device will be described with reference to the drawings.

Figure 1:
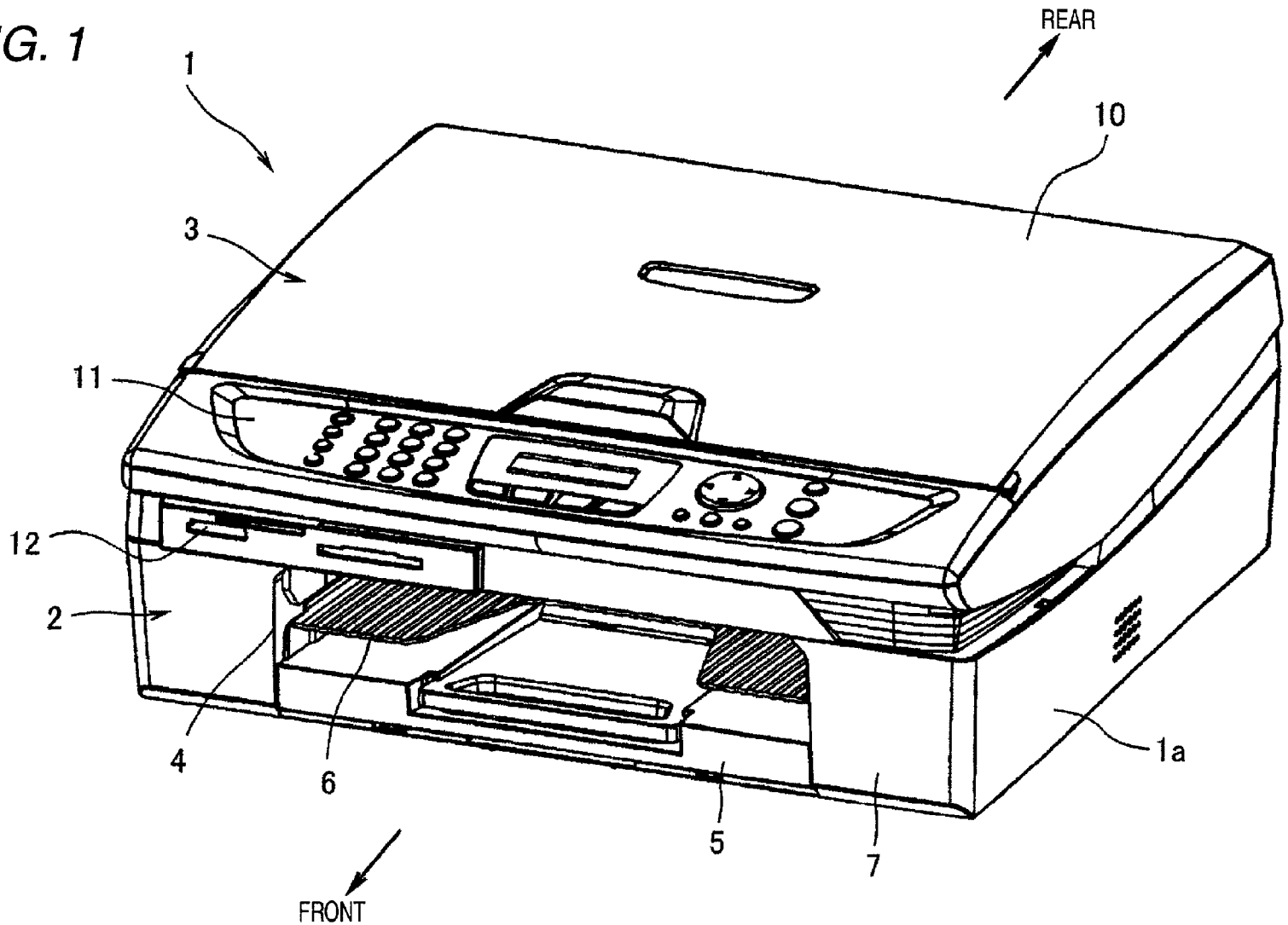
FIG. 1 is a perspective view of a liquid ejection device according to embodiments of the present invention.

FIG. 1 is a perspective view of a liquid ejection device 1 according to the embodiments of the present invention. In the embodiments, an example of the liquid ejection device 1 is shown as a multi function device having multiple functions such as a printer function, a scanner function, a copying function, a facsimile function. The liquid ejection device 1 includes a controller 13 (see FIG. 2) configured to control the entire functions of the printer, scanner, copying and facsimile functions. As shown in FIG. 1, the liquid ejection device 1 includes: a printer unit 2 configured to record an image by an inkjet method and disposed at a lower portion of a housing 1*a* of substantially rectangular parallelepiped shape; and a scanner unit 3 disposed at an upper portion of the housing 1*a*.

The printer unit 2 of the liquid ejection device 1 has an opening 4 at a front surface (front side) of the housing 1*a*. At an inner side of the opening 4, a lower sheet feeding tray 5 and an upper sheet discharging tray 6 are disposed in two stages. The sheet feeding tray 5 can house a plurality of recording sheets as recording media. Also, various sizes of the recording sheet can be allowed to be housed in the sheet feeding unit, and the maximum size of the recording sheet is, for example, A4 size.

A door 7 is provided at a lower right portion of the front surface of the printer unit 2 to selectively open and close, and a main tank mounting portion 8 (see FIG. 2) is provided at an inner side of the door 7. Thus, when the door 7 is opened, the main tank mounting portion 8 is exposed to the front side, and a main tank (also referred to as an "ink cartridge") 9 (see FIG. 2) is mountable and detachable from the front side along a horizontal direction. The printer unit 2 can perform a color print using five types of ink, i.e., dye inks of cyan (C), magenta (M), yellow (Y) and photo black (PBk) inks, and a pigment ink of black (Bk) ink. The main tank mounting portion 8 includes housing chambers corresponding to the respective ink colors. Five housing chambers are thus partitioned in the main tank mounting portion 8, and the main tanks 9 that store the inks of the respective colors of cyan (C), magenta (M), yellow (Y), photo blank (PBk), and black (Bk) are housed in the respective housing chambers.

The scanner unit 3 is provided at the upper portion of the liquid ejection device 1 and serves as a flat head scanner. That is, as shown in FIG. 1, on an upper surface of the liquid ejection device 1, a document cover 10 is configured to selectively open and close and provided as a top plate of the liquid ejection device 1. At a lower side of the document cover 10, there are provided a platen glass on which a document is allowed to be placed, an image sensor configured to read an image of the document.

An operation panel 11 configured to receive an input for operating the printer unit 2 and the scanner unit 3 is provided on an upper portion of the front surface of the liquid ejection device 1. The operation panel 11 includes various operation buttons and a liquid crystal display, and the liquid ejection device 1 is operable based on instructions output from the operation panel 11 as a result of operation of the operation panel 11 by a user. Also, an external computer is connectable to the liquid ejection device 1, and the liquid ejection device 1 may be operable based on instructions transmitted from the computer via a printer driver or a scanner driver.

A slot portion 12 is provided at an upper left portion of the front surface of the liquid ejection device 1. A storage medium such as a compact memory card as one of various types of media is mountable to the slot portion 12, and data stored in the compact memory card mounted to the slot portion 12 can be read by performing a predetermined operation at the operation panel 11. The read data can be displayed on the liquid crystal display of the operation panel 11, and an image arbitrarily selected based on this display can be recorded onto a recording sheet by means of the printer unit 2.

Figure 2:
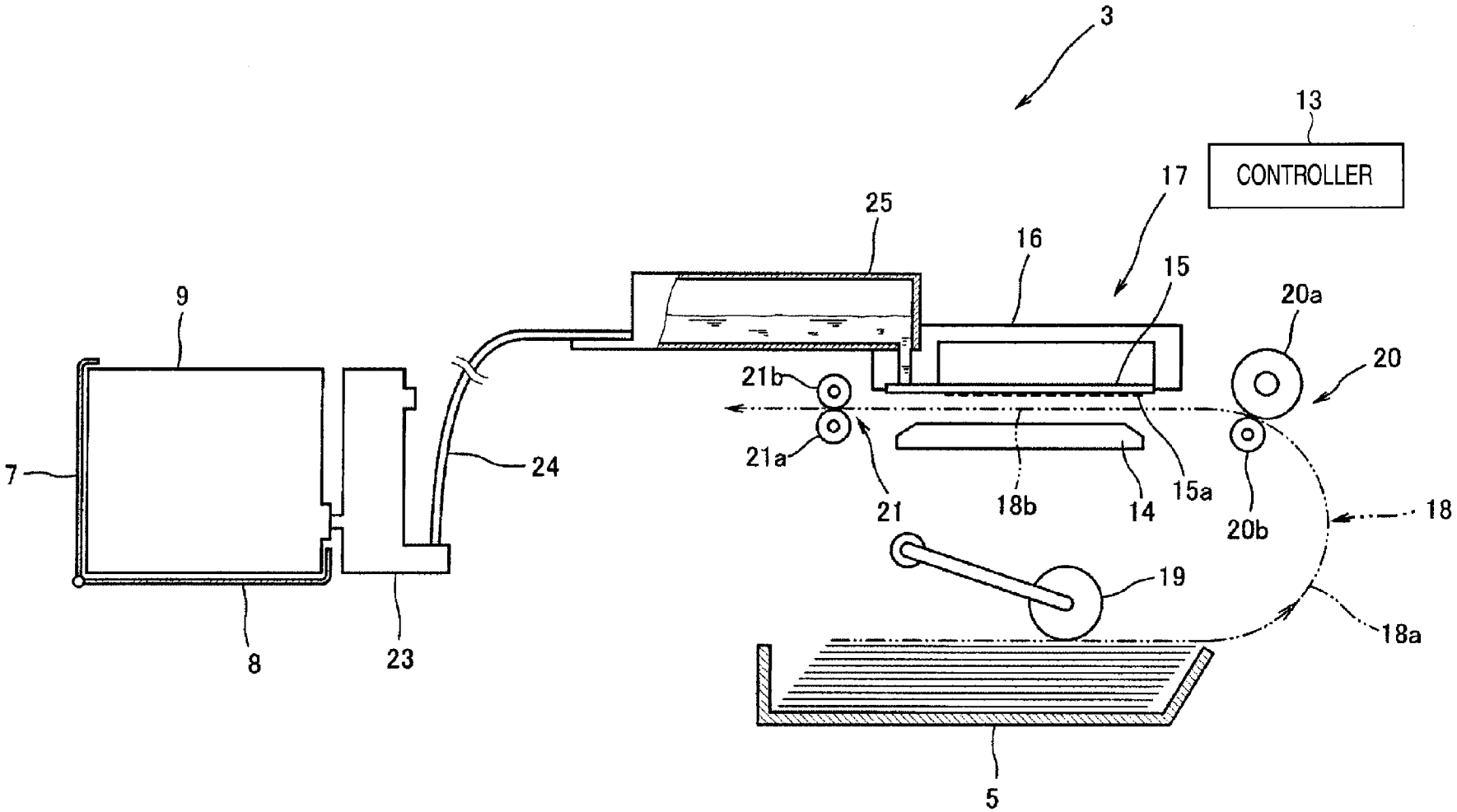
FIG. 2 is a cross-sectional view of a printer unit.

FIG. 2 is a schematic sectional view of the printer unit 2. As shown in FIG. 2, the sheet feeding tray 5 is disposed in a vicinity of a bottom portion of the liquid ejection device 1. A flat, plate-like platen 14 having a relatively long length along a left/right direction is provided above the sheet feeding tray 5. Above the platen 14, there is provided an image recording unit 17 including an ejection head 15 configured to eject an ink from nozzle holes 15*a* and mounted on a carriage 16. A sheet conveying path 18 extends from a rear of the sheet feeding tray 5. The sheet conveying path 18 includes a curved path 18*a* that curves to lead upward and then toward the front from the rear of the sheet feeding tray 5, and a straight path 18*b* extending further forward from an end of the curved path 18*a*. The sheet conveying path 18 is defined by an outer guide surface and an inner guide surface which are oppose each other across a predetermined interval, expect where the image recording unit 17 is disposed.

A sheet feeding roller 19 configured to supply a recording sheet stored in the sheet feeding tray 5 to the sheet conveying path 18 is disposed directly above the sheet feeding tray 5. In the vicinity of a downstream portion of the curved path 18*a* in the sheet conveying path 18, a conveying roller pair 20 including a conveying roller 20*a* and a pinching roller 20*b* is provided so that the sheet conveying path 18 is sandwiched from above and below by the respective rollers 20*a* and 20*b*. Furthermore, in the vicinity of a downstream portion of the straight path 18*b* in the sheet conveying path 18, a sheet discharging roller pair 21 including a sheet discharging roller 21*a* and a pinching roller pair 21*b* is provided so that the sheet conveying path 18 is sandwiched from above and below by the respective rollers 21*a* and 21*b*. The ejection head 15 and the platen 14 are provided to sandwich the straight path 18*b* from above and below, between the conveying roller pair 20 and the sheet discharging roller pair 21 with respect to the sheet conveying path 18.

The ejection head 15 is supported by a guide rod (not shown) extending in the left/right direction such that the ejection head is slidable in the left/right direction (length direction of the platen 18). The ejection head 15 is coupled to a head driving mechanism (not shown) including a pulley and belt. The ejection head 15 can scan within a predetermined range in the left/right direction along the guide rod based on the drive of the head driving mechanism.

According to the printer unit 2, a recording sheet stored in the sheet feeding tray 5 is fed by the sheet feeding roller 19 to the sheet conveying path 18 and is then conveyed by the conveying roller pair 20 along the sheet conveying path 18 from the curved path 18*a* to the straight path 18*b*. When the recording sheet reaches the straight path 18*b* and opposes to the ejection head 15, the recording sheet is subject to an image recording by the ink ejected from the ejection head 15. When the recording is completed, the recording sheet is discharged from the straight path 18*b* by the sheet discharging roller pair 21 and housed in the sheet discharging tray 6 (see FIG. 1).

Ink from a main tank 9 detachably mounted to a main unit or the liquid ejection device 1 is supplied to the ejection head 15 provided in the printer unit 2. More specifically, as shown in FIG. 2, the liquid ejection device 1 includes a sub tank 23 for gas-liquid separation, and when the main tank 9 is mounted to the tank mounting portion 8, the sub tank 23 is brought into fluid communication with the main tank 9 and is supplied with the ink from the main tank 9. The sub tank 23 is connected to a buffer tank 25 via a flexible ink supplying tube 24, and the buffer tank 25 is connected to an upper portion of the ejection head 15. Thus, by driving of an actuator (not shown) such as a piezoelectric element provided in the ejection head 15, the ink stored in the ejection head 15 is ejected from the nozzle holes 15*a* and the ink stored in the sub tank 23 is supplied to the ejection head 15 via the ink supplying tube 24 and the buffer tank 25.

As mentioned above, the liquid ejection device 1 according to the embodiments is of a so-called tube supply type. In the tube supply type, the main tank 9 is directly connected to the sub tank 23, and the ejection head 15 is connected to the sub tank 23 via the flexible ink supplying tube 24, thereby the ink supplying flow path from the main tank 9 to the ejection head 15 is always established. However, the liquid ejection device and the sub tank according to the embodiments are not limited in a tube supply type and may be of a station type (also called an "on-demand type"), in which the ink supplying flow path leading from the main tank 9 to the ejection head 15 is established only during replenishing of the ink.

Embodiment 1

An Embodiment 1 will be described in regard to the main tank 9 and the sub tank 23.

(Configuration of the Main Tank)

Figure 3:
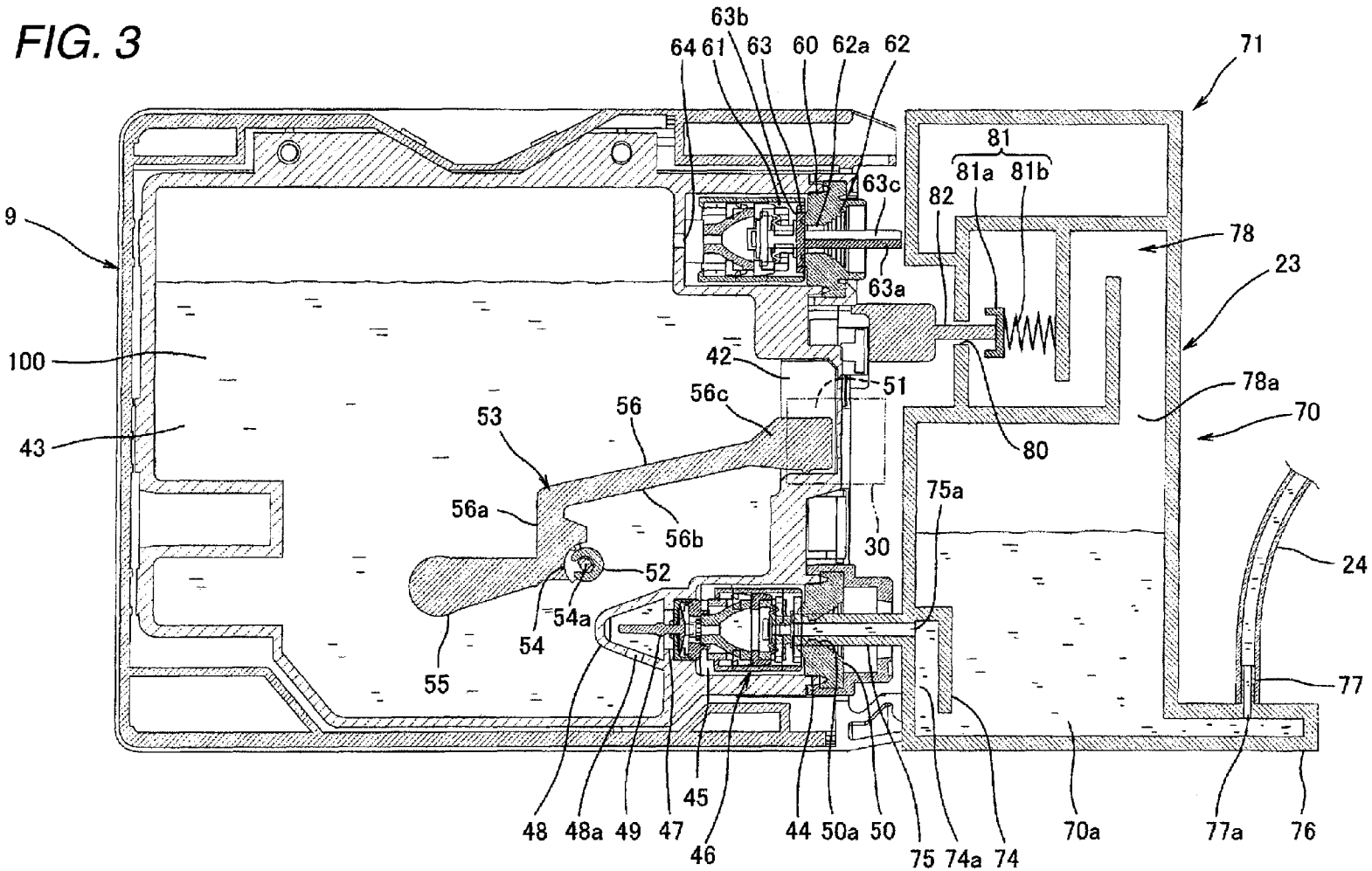
FIG. 3 is a vertical cross-sectional view of a main tank and a sub tank according to an Embodiment 1.

FIG. 3 is a cross-sectional view of an the main tank 9 and the sub tank 23 according to the Embodiment 1. As shown in FIG. 3, both the main tank 9 and the sub tank 23 have a substantially rectangular, box shape in side view. The main tank 9 is disposed at a lateral side of the sub tank 23 so that bottom surfaces of both are disposed on a substantially same plane.

The main tank 9 includes an ink storage chamber 43 defined therein configured to store ink 100. An opening 44 and a tubular valve housing chamber 45 continuous with the opening 44 are formed through a lower portion of a wall surface (at the right side in FIG. 3) of the main tank 9 opposing the sub tank 23. The valve housing chamber 45 extends from the opening 44 toward an inner side of the main tank 9, and an ink supplying valve 46 is housed in the valve housing chamber 45. A valve port 47 is formed on an inner surface of the valve housing chamber 45 which is opposite to the opening 44. A hollow, conical cover portion 48 is protruded from a circumference of the valve port 47 toward the inner side of the main tank 9.

An inflow port 48*a* is formed at a lower portion of the cover portion 48, and the valve housing chamber 45 is brought into fluid communication with the ink storage chamber 43 via the valve port 47 and the inflow port 48*a*. The valve port 47 is provided with a check valve 49, and the check valve 49 opens the valve port 47 when the ink storage chamber 43 becomes positive in pressure with respect to the valve housing chamber 45 and closes the valve port 47 when the ink storage chamber 43 becomes negative in pressure with respect to the valve housing chamber 45. An annular sealing member 50 is disposed at the opening 44, and an ink outflow port 50*a* is formed at a center portion of the sealing member 50. The diameter of the ink outflow port 50*a* is reduced by elastic force in a non-loaded state.

An opening 60 and a tubular valve chamber 61 continuous with the opening 60 are disposed at an upper portion of the wall surface (at the right side in FIG. 3) of the main tank 9 opposing the sub tank 27. An annular sealing member 62 is disposed at the opening 60, and an atmosphere opening port 62*a* is formed at a center of the sealing member 62. The valve housing chamber 61 extends from the opening 60 toward inside the main tank 9, and an atmospheric release valve 63 is housed in the valve housing chamber 61. The atmospheric release valve 63 includes: a rod portion 63*a* that penetrates through the atmosphere port 62*a* and protrudes outside toward the sub tank 23 side; and a flange portion 63*b* that projects in outward radial directions from an inner end portion of the rod portion 63*a*. The atmospheric release valve 63 is urged so that the flange portion 63*b* contacts the sealing member 62 and thereby seals the atmosphere opening port 62*a*. A groove portion 63*c* is disposed along a direction of extension of the rod portion 63*a*, and in a state where the flange portion 63*b* is separated from the sealing member 62, the valve housing chamber 61 is open to an atmosphere via the groove portion 63*c*. A communication port 64 is formed at a surface of a back wall of the valve housing chamber 61, and the valve housing chamber 61 is brought into fluid communication via the communication port 64 with an air layer formed at an upper portion of the ink storage chamber 43.

A recess 42 is formed at an inner wall surface of the main tank 9 on the side the sub tank 23, and a space surrounded by the recess 42 is continuous with the ink storage chamber 43. Each of the both side walls (near side and far side in the sheet of FIG. 3) of the recess 42 has a light transmitting portion 51 formed of a transmissive material for detecting the remaining amount of the ink stored in the ink storage chamber 43. The main tank 9 includes a supporting portion 52 configured to swingably support a sensor arm 53. The sensor arm 53 includes: a connecting portion 54 having a connecting shaft 54*a* axially supported by the supporting portion 52; a float portion 55 extending to one side (the left side in FIG. 3) from the connecting portion 54; and an arm portion 56 extending to another side (the right side in FIG. 3) from the connecting portion 54.

The float portion 55 is formed to be hollow so that an average specific gravity thereof is less than a specific gravity of the ink. The arm portion 56 includes a first arm 56*a*, a second arm 56*b*, and a blocking portion 56*c*. The first arm 56*a* extends upward substantially perpendicularly with respect to the float portion 55. The second arm portion 56*b* extends from a front end of the first arm 56*a* in a direction away from the float portion 55. The blocking portion 56*c* positioned in the recess 42 is formed at a front end of the second arm portion 56*b*.

The arm portion 56 has lighter weight than the float portion 55 and also has smaller buoyancy than the float portion 55 when the arm portion 56 is immersed in the ink. Therefore, in a state where there is no ink in the ink storage chamber 43, the sensor arm 53 rotates about the connecting shaft 54*a* in a direction in which the float portion 55 descends. In this process, the blocking portion 56*c* of the sensor arm 53 moves so as to retreat diagonally upward from the recess 42. On the other hand, when the ink storage chamber 43 is adequately filled with inks the float portion 55 is immersed in the ink, the weight balance of the float portion 55 and the arm portion 56 is reversed due to buoyancy, and the sensor arm 53 rotates about the connecting shaft 54*a* in a direction in which the float portion 55 rises. In this process, the blocking portion 56*c* of the sensor arm 53 moves diagonally downward so as to enter the recess 42.

A remaining amount detecting sensor 30 is disposed at the main tank mounting portion 8 (see FIG. 2). As shown in FIG. 3, the remaining amount detecting sensor 30 is positioned so that when the main tank 9 is mounted to the main tank mounting portion 8, the recess 42 of the main tank 9 becomes positioned at a position corresponding to the remaining amount detecting sensor 30. The remaining amount detecting sensor 30 includes a light emitting unit and light receiving unit (not shown) that are positioned opposite each other across the main tank 9, and light emitted from the light emitting unit is transmitted through the light transmitting portions 51 of the main tank 9 and received by the light receiving unit. Therefore, while the blocking portion 56 of the sensor arm 53 is positioned between the light transmitting portions 51, the light receiving unit cannot receive light. When the blocking portion 56 rotates and retreats from a portion between the light transmitting portions 51, the light can be received. Accordingly, the position of the blocking portion 56, that is, whether or not the remaining ink amount in the ink storage chamber 43 is no less than a predetermined amount (a small amount close to empty), can be detected according to whether the light can be received.

(Configuration of the Sub Tank)

Next, the sub tank 23 is described with reference to FIG. 3. The sub tank 23 includes an ink storage container 70 configured to store ink and positioned at a lower portion, and an atmospheric introduction portion 71 positioned at an upper portion and configured to allow a fluid communication between the inside of the ink storage container 70 and an atmosphere. The sub tank 23 has substantially the same height as the main tank 9.

In the ink storage container 70, a flow path wall 74 horizontally extends from a side wall on the main tank 9 side toward the inside of the sub tank 23 and then extends downward. An ink inflow path 74*a* is defined by the flow path wall 74 and the side wall on the main tank 9 side. The ink inflow path 74*a* extends from a predetermined height position in an inner space 70*a* of the ink storage container 70 to a lower position in the vicinity of an inner bottom wall of the ink storage chamber 70 and is brought into communication with the inner space 70*a* at its lower end portion.

A tubular needle portion (connection portion) 75 is protruded toward the main tank 9 side from a main tank 9 side outer wall of the sub tank 23, and the needle portion 75 includes a liquid inlet 75*a* that opens toward an upper end of an ink inflow path 74*a* of the ink storage container 70. When the needle portion 75 is inserted in the ink outflow port 50*a* of the sealing member 50 of the main tank 9, the inner space 70*a* of the ink storage container 70 of the sub tank 23 is brought into fluid communication with the ink storage chamber 43 of the main tank 9 via the ink inflow path 74*a*.

Furthermore, on an outer wall of the sub tank 23, a hollow protrusion 76 is provided to protrude in a direction away from the main tank 9. An inner space of the protrusion 76 constitutes a portion of the inner space 70*a*. A tubular tube attachment portion 77 is provided to protrude upward from an upper wall portion of the protrusion 76 such that the tubular tube attachment portion fluid-communicates with the inner space of the protrusion 76. The tube attachment portion 77 has a liquid outlet 77*a* the opens toward the inner space 70*a* of the ink storage container 70, and the liquid outlet 77*a* is disposed at a position lower than the liquid inlet 75*a*. When one end of the ink supplying tube 24 (see also FIG. 2) is connected to the tube mounting portion 77, the inner space 70*a* of the ink storage container 70 of the sub tank 23 is brought into fluid communication with the buffer tank 25 (see FIG. 2) of the image recording unit 17 via the ink supplying tube 24.

Meanwhile, the atmospheric introduction portion 71 has a labyrinth flow path 78 for gas/liquid separation. The labyrinth flow path 78 switches the direction of flow of air alternatingly from upward to downward and then from downward to upward. The labyrinth flow path 78 has a first opening 78*a* at one end and a second opening 80 at the other end. The first opening 78*a* is positioned above the liquid inlet 75*a* and at an uppermost end of the inner space 70*a* of the ink storage container 70, and opens toward the inner space 70*a* to constitute an atmosphere opening of the ink storage container 70. The second opening 80 is formed through an outer wall of the sub tank 23 so as to open toward the main tank 9 side. A valve mechanism 81 is disposed inside the second opening 80, and the valve mechanism 81 includes a valve body 81*a* and an urging member 81*b* such as a coil spring. The valve body 81*a* is urged by the urging member 81*b* in a direction to close the second opening 80.

The main tank 9 includes an atmosphere opening pin 82 protruding from a side wall of the main tank 9 on the sub tank 23 side toward the sub tank 23 side. The atmosphere opening pin 82 is inserted through the second opening 80 of the sub tank 23 when the main tank 9 is mounted to the main tank mounting portion 8. Thus, when the atmosphere opening pin 82 is inserted through the second opening 80, the valve body ala is moved against the urging force of the urging member 81*b* and the inner space 70*a* of the ink storage container 70 of the sub tank 23 is thereby opened to the atmosphere via the labyrinth flow path 78.

(Functions of the Sub Tank)

Figure 4A:
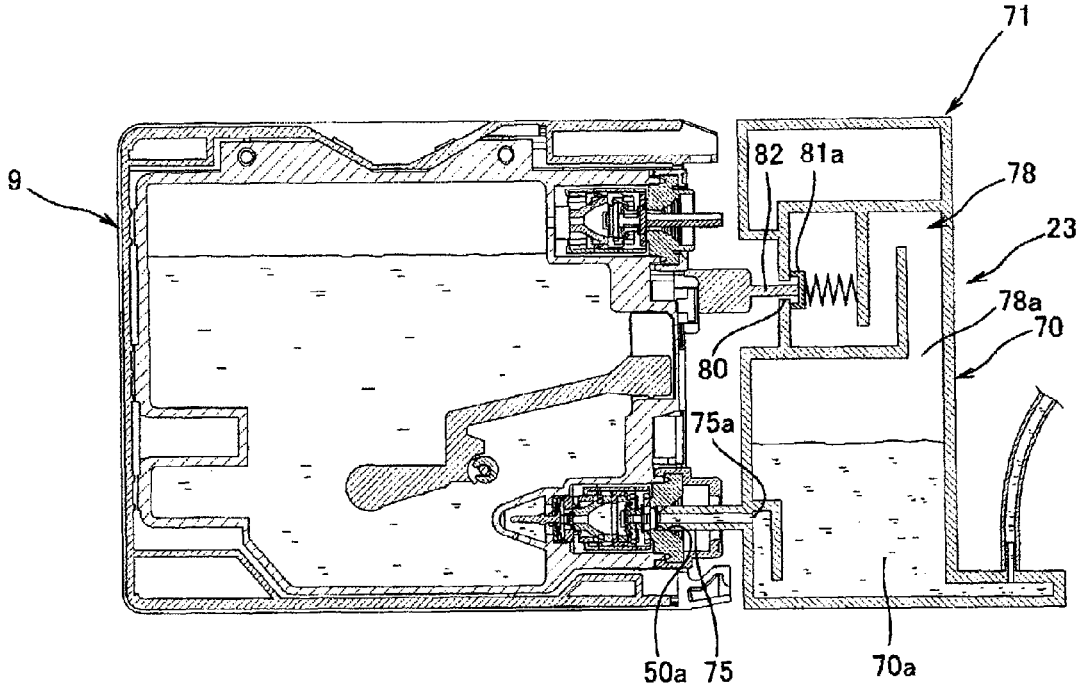
Figure 4B:
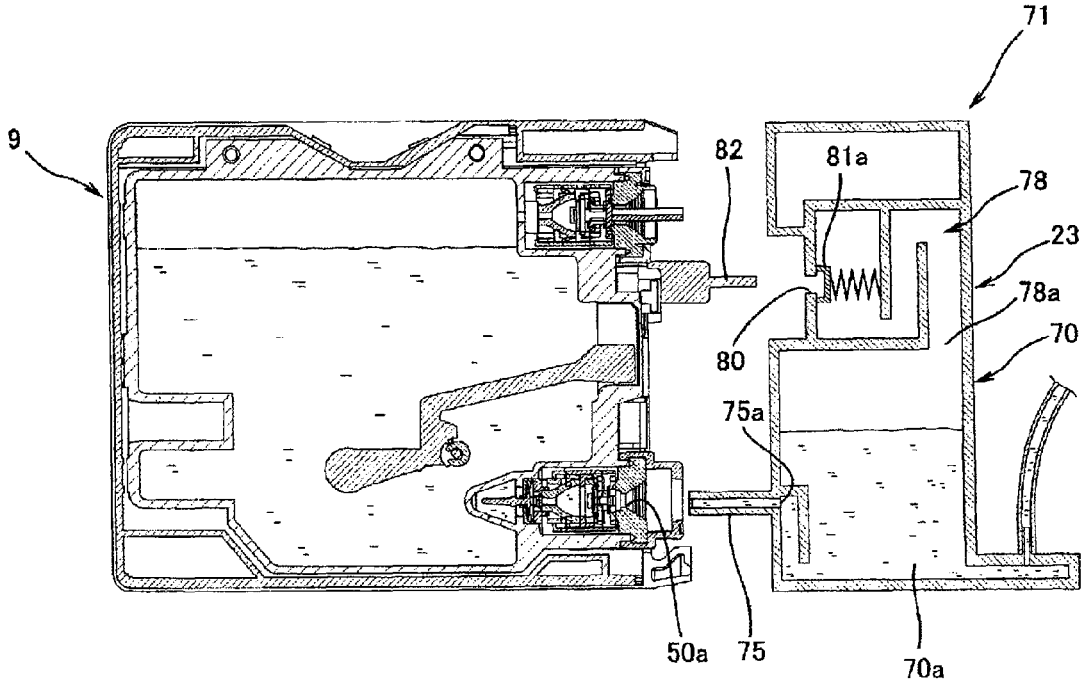

The sub tank 23 provided in the liquid ejection device 1 can prevent ink leakage when the main tank 9 is detached from the main tank mounting portion 8. The ink leakage prevention function of the sub tank 23 will be described in detail as a function of the liquid ejection device 1. FIGS. 4A and 4B are diagrams for describing the function of preventing ink leakage from the sub tank 23, in which FIG. 4A shows the main tank 9 slightly separated from the sub tank 23 and FIG. 4B shows the two components being completely separated.

First, there is provided a description regarding a case where the main tank 9 is detached from a state in which the main tank 9 is mounted to the main tank mounting portion 8 (see FIG. 2) and connected to the sub tank 23 as shown in FIG. 3. As shown in FIG. 4A, when the main tank 9 is just slightly separated from the sub tank 23, the atmosphere opening pin 82 that has been inserted through the second opening 80 retreats, and the valve body 81*a* closes the second opening 80. Thus, immediately before the main tank 9 separates completely, the first opening 78*a* that opens toward the ink storage container 70 becomes closed to the atmosphere, and the ink storage container 70 is brought into a sealed state.

In the state shown in FIG. 4A, at least a front end portion of the needle portion 75 of the sub tank 23 is inserted through the ink outflow port 50*a* of the main tank 9, and the needle portion 75 and the ink outflow port 50*a* form no gap where ink can leak out. In this state, the fluid communication between the main tank 9 and the sub tank 23 via the needle portion 75 may be or may not be established.

Next, when the main tank 9 is separated completely from the sub tank 23 as shown in FIG. 4B, the needle portion 75 of the sub tank 23 separates from the ink outflow port 50*a* of the main tank 9, and the front end of the needle portion 75 becomes open to the atmosphere. However, the opening at the front end of the needle portion 75 is small in diameter and menisci are formed upon separation from the ink outflow port 50*a* of the main tank 9. Moreover, since the inside of the ink storage container 70 of the sub tank 23 is in a state where the first opening 78 (the second opening 80) is closed, the inside of the ink storage container 70 becomes a negative pressure (i.e., lower than atmospheric pressure) by the ink's own weight. Thus, due to the menisci and the negative pressure, the ink inside the sub tank 23 is prevented from leaking out to the exterior through the needle portion 75.

According to the main tank 9 and the sub tank 23 of the Embodiment 1, when the main tank 9 is detached from state where the two components are brought into fluid communication via the liquid inlet 75*a*, the second opening 80 closes and the inside of the sub tank 23 is in the sealed state at first, and then the main tank 9 is detached completely from the sub tank 23 so that the liquid inlet 75*a* is opened to the atmosphere. Thus, even when the main tank 9 is detached in a state where ink remains inside the sub tank 23, the residual ink stored in the sub tank 23 does not leak out to the exterior through the liquid inlet 75*a*.

Meanwhile, in a case where a new main tank 9 is mounted to the main tank mounting portion 8 and connected to the sub tank 23, transition occurs in the order reverse that described above, that is, from the state of FIG. 4B to the connected state shown in FIG. 3 via the state of FIG. 4A. That is, when the main tank 9 is connected to the sub tank 23, at first, the state is transited from a state where the two components are completely separated as shown in FIG. 4B to a state where the front end portion of the needle portion 75 is inserted through the ink outflow port 50*a* of the main tank 9 (the fluid communication between the main tank 9 and the sub tank 23 via the liquid inlet 74*a* may be or may not be established) as shown in FIG. 4B. In this state, the second opening 80 has not been opened yet. Thereafter, when the main tank 9 is completely mounted to the main tank mounting portion 8 (see FIG. 2), the needle portion 75 is further inserted deeper as shown in FIG. 3 so that the second opening 80 is opened thereby the atmosphere is introduced into the inner space 70*a* of the ink storage container 70 of the sub tank 23, and the main tank 9 is brought into fluid communication with the sub tank 23 via the liquid inlet 75*a*.

Thus, when the main tank 9 is completely mounted to the main tank mounting portion 8, and also the main tank 9 is brought into fluid communication with the sub tank 23 via the liquid inlet 75*a*, the atmosphere is introduced into the inside of the sub tank 23, which allows the smooth supply of ink from the main tank 9 to the sub tank 23. Also, when the atmosphere is introduced into the inside of the sub tank 23, the front end portion of the needle portion 75 is inserted through the ink outflow port 50*a* of the main tank 9, thereby the ink in the sub tank 23 does not leak out to the exterior via the liquid inlet 75*a*.

Embodiment 2

A liquid ejection device 1 according to an Embodiment 2, in particular, the sub tank 23 will be described.

Figure 5:
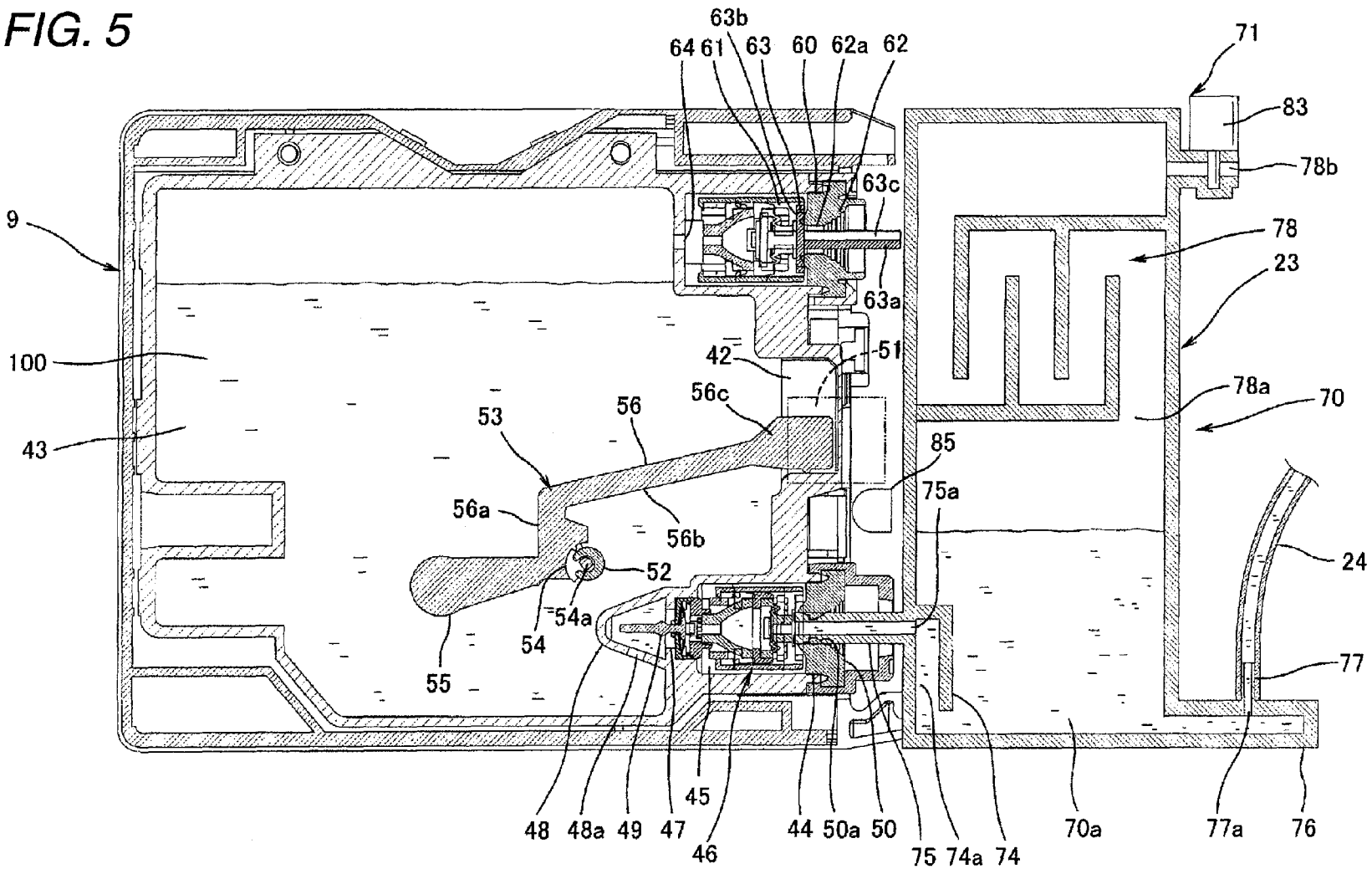
FIG. 5 is a vertical cross-sectional view of a main tank and a sub tank according to an Embodiment 2.

FIG. 5 is a vertical cross-sectional view of the sub tank 23 according to the Embodiment 2. As shown in FIG. 5, although the sub tank 23 according to the Embodiment 2 is similar to the sub tank 23 according to the Embodiment 1 (see FIG. 3), it differs in that in place of the valve mechanism 81 of the Embodiment 1, a solenoid valve 83 is disposed in a second opening 78*b* provided in the labyrinth flow path 78.

The main tank mounting portion 8 (see FIG. 2) is provided with a sensor 85 for detecting whether a main tank 9 is mounted thereto. More specifically, the sensor 85 is configured to detect whether the main tank 9 is in a valve driving state. The valve driving state includes two states, in which one state indicates that the main tank 9 is about to be separated from the main tank mounting portion 8, and the other state indicates that the main tank 9 is mounted to the main tank mounting portion 8 and the ink supplying valve 46 of the main tank 9 is closed (the main tank 9 is in a sealed state) and also the front end of the needle portion 75 of the sub tank 23 is inserted through the ink outflow port 50*a* of the main tank 9.

Since the configuration of the main tank 9 and the sub tank 23 according to the Embodiment 2 except the above is the same as that of the Embodiment 1 shown in FIG. 3, detailed description thereof shall be omitted.

According to the sub tank 23 of the Embodiment 2 having the above configuration, when the main tank 9 is detached and the valve driving state is detected by the sensor 85, the detection signal is input into the controller 13 (see FIG. 2) provided in the liquid ejection device 1. Based on the input signal, the controller 13 drives the solenoid valve 83 to switch the second opening 78*b* of the sub tank 23 from an open state to a closed state. This operation of closing the second opening 78*b* by the solenoid valve 83 is completed during the above-described valve driving state, and thereafter, the main tank 9 is detached completely from the sub tank 23.

When the main tank 9 is connected to the sub tank 23 and the valve driving state is detected by the sensor 85 upon approaching of the two components, the detection signal is input into the controller 13 and the controller 13 outputs a drive signal based on the detection signal. Based on the drive signal, the second opening 78*b* is switched from the closed state to the open state. This operation of opening the second opening 78*b* by the solenoid valve 83 is completed during the above-described valve driving state, and thereafter, the main tank 9 becomes completely connected to the sub tank 23 and the two components are brought into fluid communication through the liquid inlet 75*a*.

The solenoid valve 83 of the Embodiment 2 is controlled to open and close at the substantially same timings as the opening and closing timings of the valve mechanism 81*l* of the Embodiment 1. The sub tank 23 according to the Embodiment 2 can thus prevent the leakage of residual ink from the sub tank 23 during detachment of the main tank 9 and exhibit the effect of enabling smooth ink supply during mounting of the main tank 9 as described with the Embodiment 1 and can thus exhibit the same or similar effects as those described with the Embodiment 1.

Embodiment 3

A liquid ejection device 1I according to an Embodiment 3, in particular, the sub tank 23 will be described. According to the sub tank 23 of the Embodiment 3, even when menisci are formed at a portion connecting to the main tank 9, the menisci can be broken. Therefore, the ink can be guided from the main tank 9 into the sub tank 23, and air can be prevented from entering into the ejection head 15 via the ink supplying tube 24.

That is, in the process of mounting the main tank 9 to the main tank mounting portion 8 and connecting to the sub tank 23, air may enter into a portion at which the main tank 9 and the sub tank 23 are connected (for example, a portion in the vicinity of the needle portion 75 in the Embodiment 3). This results in that menisci may be formed by this air. In order to break the menisci to draw the ink stored in the main tank 9 into the sub tank 23 by driving an actuator (not shown) of the ejection head 15, the inside of the sub tank 23 is made negative in pressure. However, in the state where the sub tank 23 is connected to the main tank 9, the sub tank 23 is open to the atmosphere as mentioned above. Therefore, it is difficult to make the inside of the sub tank 23 negative in pressure and break the menisci. Meanwhile, since the atmosphere is introduced into the sub tank 23, the ink stored in the sub tank 23 is supplied via the ink supplying tube 24 to the ejection head 15 by driving of the actuator. Consequently, the ink in the main tank 9 is not supplied to the ejection head 15, and only the ink stored in the sub tank 23 is supplied. Therefore, after the ink in the sub tank 23 is used up, the air may enter the ink supplying tube 24.

The sub tank 23 according to the Embodiment 3 has an advantage to break the menisci, in addition to the advantage to preventing ink leakage as described with the Embodiments 1 and 2.

Figure 6:
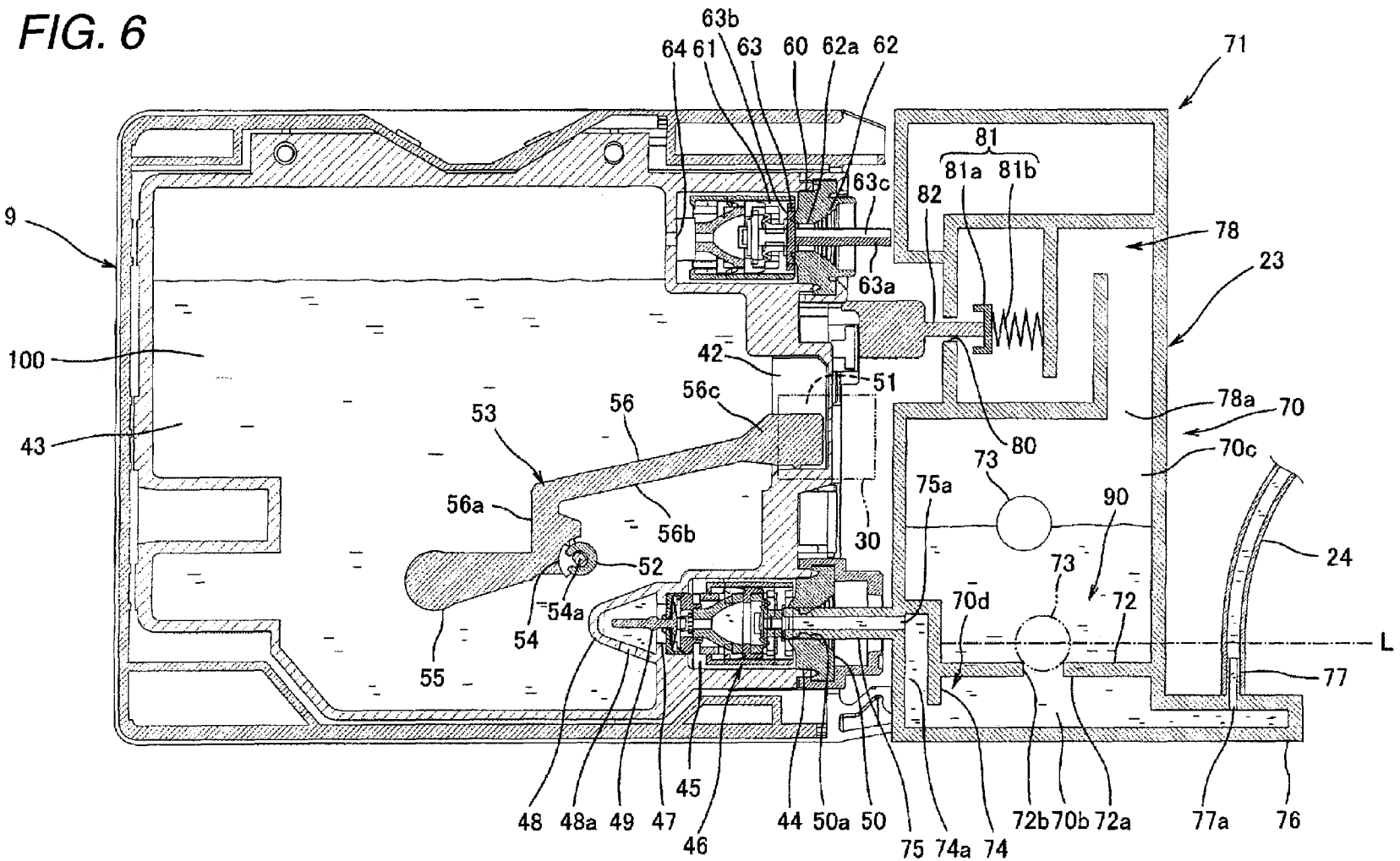
FIG. 6 is a vertical cross-sectional view of a main tank and a sub tank according to an Embodiment 3.

FIG. 6 is a vertical cross-sectional view of the main tank 9 and the sub tank 23 according to the Embodiment 3. As shown in FIG. 6, the sub tank 23 according to the Embodiment 3 has a partitioning plate 72 that partitions the inner space 70*a* of the ink storage container 70 into a lower chamber 70*b* and an upper chamber 70*c*. The partitioning plate 72 is disposed horizontally at a predetermined height position between the liquid inlet 75*a* and the liquid outlet 77*a* in the vertical direction. A valve seat 72*a* is disposed at substantially the center of the partitioning plate 72. A communicating port 72*b* as a round hole is formed at the valve seat 72*a* to penetrate through the partitioning plate 72 in the vertical direction allow a fluid communication between the lower chamber 70*b* and the upper chamber 70*c*.

A spherical float 73 having a diameter greater than the opening of the communicating port 72*b* is disposed in the upper chamber 70*c* of the ink storage container 70. The float 73 has a smaller specific gravity than the ink. Therefore, when the upper chamber 70*c* is filled with the ink, the float 73 is positioned at an upper portion due to buoyancy. On the other hand, when the ink level drops to a predetermined position L or less, the float 73 moves downward at the level of the ink drops, and closes the communicating port 72*b* of the valve seat 72*a* (as indicated by the alternate long and two short dashes line in FIG. 6). That is, the float 73 selectively opens and closes the communicating port 72*b* depending on the ink level of the ink storage container 70.

In the lower chamber 70*b*, an air trapping space 70*d*, is defined by a portion of the flow path wall 74 extending downward below the partitioning plate 72, the partitioning plate 72, and an outer wall surface of the ink storage container 70, so that the air trapping space 70*d* is formed of a recess opened downward which is capable of trap air. Also the air trapping space 70*d* is designed to have capacity greater than the volume of air that may enter into the connection portion of the main tank 9 and the sub tank 23 when the two are connected.

Since the configuration of the main tank 9 and the sub tank 23 according to the Embodiment 3 except the above is similar as that of the Embodiment 1 shown in FIG. 3, detailed description thereof is omitted.

Figure 7A:
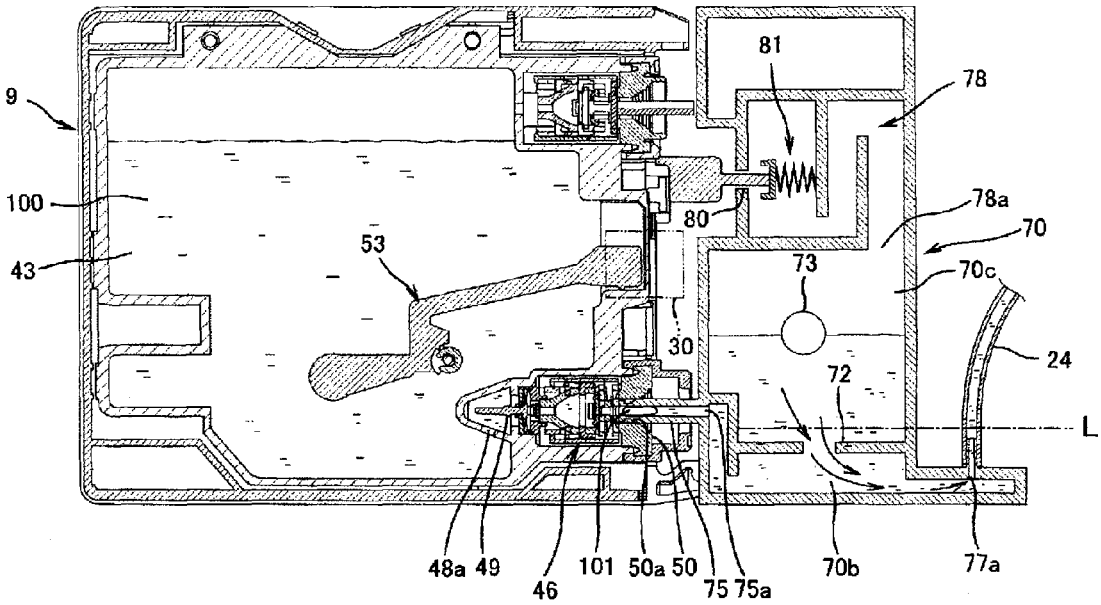
Figure 7B:
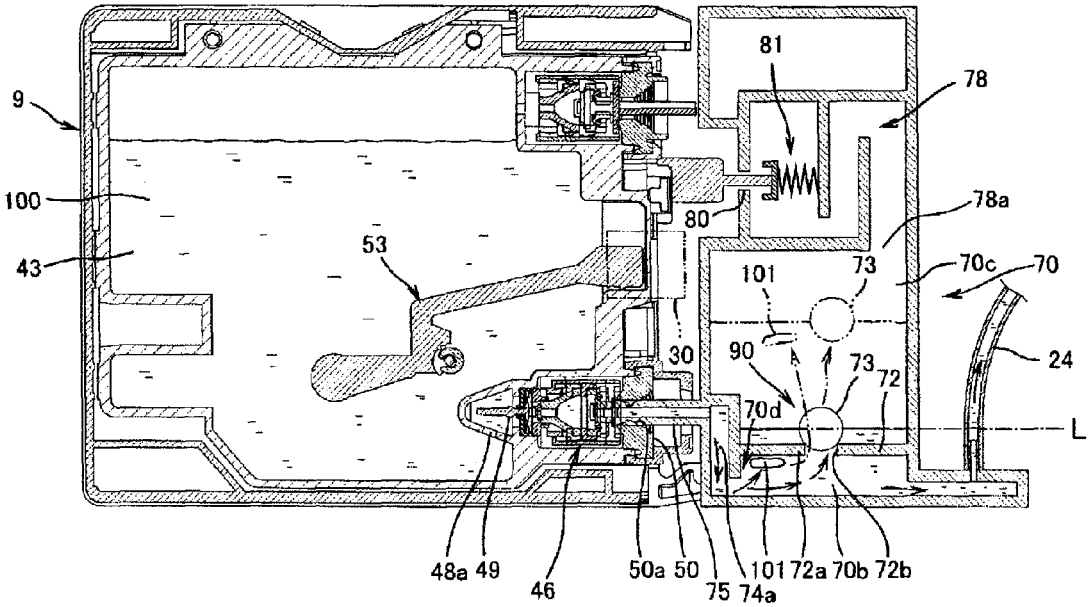

Functions of the sub tank 23 of the Embodiment 3 will be described in detail. FIGS. 7A and 7B are diagrams for describing the functions of the sub tank 23, in which FIG. 7A shows the main tank 9 mounted to the main tank mounting portion 8 and menisci formed at the connection portion of the main tank 9 and the sub tank 23, and FIG. 7B shows the menisci having been broken.

As shown in FIG. 7A, when the main tank 9 is mounted to the main tank mounting portion 8 (see FIG. 2), air 101 enters into the connection portion of the main tank 9 and the sub tank 23 (the portion in the vicinity of the main tank 9 side end of the needle portion 75 in FIG. 7), thereby forming menisci. When the ink is ejected from the ejection head 15 (see FIG. 2) in this state, the ink stored in the sub tank 23 is supplied to the ejection head 15 through the ink supplying tube 24, but the ink stored in the main tank 9 is obstructed by the menisci and is not supplied to the sub tank 23. In FIG. 7A, a comparatively large amount of ink is stored in the ink storage container 70 of the sub tank 23, and the ink level is positioned at no less than the predetermined position L in the upper chamber 70*c*. Therefore, the float 73 floats and is positioned above and separated from the partitioning plate 72.

Then, as shown in FIG. 7B, when the ink stored in the sub tank 23 decreases and the ink level drops to below the predetermined position L, the float 73 moves downward accordingly and eventually closes the communicating hole 72*b* formed in the valve seat 72*a* of the partitioning plate 72. Hence, the lower chamber 70*b* and the upper chamber 70*c* are cut off with a liquid-tight maintained. The partitioning plate 72 the valve seat 72*a*, and the float 73 serve as a switching member 90 configured to allow or prevent the fluid communication between the lower chamber 70*b* and the upper chamber 70*c*.

When the lower chamber 70*b* and the upper chamber 70*c* are cut off with respect to each other, the lower chamber 70*b* is also cut off from the atmosphere, that is, not opened to the atmosphere through the atmospheric introduction portion 71. Thus, when the ink is drawn into the ejection head 15 through the ink supplying tube 24 due to ink ejection at the ink ejection head 15 in this state, the lower chamber 70*b* of the sub tank 23 is made negative in pressure. Therefore, the ink stored in the main tank 9 is drawn into the sub tank 23. The air 101 having formed the menisci in the needle portion 75 moves to the lower chamber 70*b* of the sub tank 23 through the inkflow path 74*a*, along with the ink that is drawn from the main tank 9 side. As a result, the menisci are broken and thereafter, the ink is supplied from the main tank 9 to the sub tank 23.

The air 101 having moved along with the ink to the lower chamber 70*b* of the sub tank 23 is temporarily trapped by the air trapping space 70*d* formed in the lower chamber 70*b*. As described above, the air trapping space 70*d* has capacity greater than the air 101, thereby the air 101 entering into the lower chamber 70*b* in the process of breaking the meniscus can be trapped reliably.

When the ink becomes supplied from the main tank 9 to the sub tank 23, the ink level in the ink storage container 70 of the sub tank 23 rises as indicated by the alternate long and two short dashes line in FIG. 7B, and the float 73 rises accordingly and opens the communicating hole 72*b*. Accordingly, the lower chamber 70*b* is brought into fluid communication with the upper chamber 70*c* and is opened to the atmosphere through the labyrinth flow path 78. Therefore, the air 101 can move toward the upper chamber 70 through the communicating port 72*b*, enters the labyrinth flow path 78 from the first opening 78*a*, and is discharged to the outside from the second opening 78*b*.

As can be understood from the above description, according to the liquid ejection device 1 of the Embodiment 3, even when menisci is formed during connection of the main tank 9 and the sub tank 23, the menisci can be broken so that the ink can be reliably supplied from the main tank 9 to the sub tank 23. Also, even if air of a small diameter enters into the ink supplied from the main tank 9 thereafter, this air can be subject to gas/liquid separation and discharged to the atmosphere by the function of the sub tank 23, thereby the air can be appropriately prevented from entering into the ink supplying tube 24.

In the sub tank 23 according to the Embodiment 3, the valve mechanism 81 disposed at the second opening 78*b* is also opened and closed at the same timings as those of the Embodiment 1 in accordance with the mounting and detachment of the main tank 9. Therefore, the leakage of ink can be prevented in the same manner as described in the Embodiment 1.

In the above embodiments, the second opening 78*b* or 80 provided in the sub tank 23 is opened and closed by a solenoid valve 83 or a valve mechanism 81. However, the first opening 78*a* may be opened and closed. Further, a mechanism to selectively open and close the flow path from the ink storage container 70 to the second opening 78*b* or 80 may also be disposed in the middle of the flow path. The same effects as those described above are exhibited in such a case as well.

Although the embodiments shows the inkjet recording device of the tube supply type in which the ejection head 20 and the sub tank 23 are brought into fluid communication even during image formation, the ink jet recording device may be of a so-called station supply type (also called an "on-demand type"). The present invention is also not limited to the configuration where the main tank 9 and the sub tank 23 are directly connected by the needle portion 75, and may also be applied to a configuration where the two components are indirectly connected, for example, via another tubular member with flexibility. Furthermore, the present invention is not limited to a liquid ejection device that ejects ink but can be applied to any liquid ejection device including a sub tank configured to store a liquid to be supplied to an ejection head and capable of fluid-communicating with a main tank.

The present invention can be applied to a liquid ejection device including a sub tank for gas-liquid separation between a detachable main tank and an ejection head and prevents a leak-out of liquid from the sub tank in a state where the main tank and the sub tank are not connected, and can be applied to the sub tank for use with the liquid ejection device.

What is claimed is:

1. A liquid ejection device comprising:

a main tank configured to store a liquid;

an ejection head configured to eject a liquid to a medium; and a sub tank comprising an inner space defined therein and comprising a connection portion configured to connect the inner space with the main tank, the sub tank configured to supply the liquid from the main tank to the ejection head;

wherein the sub tank comprises:

a liquid inlet through which the liquid is allowed to flow from the main tank into the inner space when the main tank is connected to the connection portion;

an atmosphere opening that communicates between an outside of the sub tank and the inner space; and a valve configured to selectively open and close the atmosphere opening, and wherein the valve opens the atmosphere opening in a state where the main tank is connected to the connection portion and closes the atmosphere opening in a state where the main tank is not connected to the connection portion.

2. The liquid ejection device according to claim 1, wherein the sub tank includes a storage container defined in the inner space and configured to store the liquid supplied from the main tank, and wherein the liquid inlet is disposed at a side portion of the storage container.

3. The liquid ejection device according to claim 1, wherein the atmosphere opening is disposed above the liquid inlet.

4. The liquid ejection device according to claim 1, wherein, when the main tank is detached from a state where the main tank is connected via the liquid inlet, the valve closes the atmosphere opening before the inner space of the sub tank is opened to an atmosphere via the liquid inlet.

5. The liquid ejection device according to claim 4, wherein when the main tank is connected to the connection portion, the valve is pushed by an atmosphere opening pin provided on the main tank and opens the atmosphere opening, when the main tank is not connected to the connection portion, the valve closes the atmosphere opening, when the main tank is detached from the state where the main tank is connected via the liquid inlet, the valve is separated from the atmosphere opening pin and closes the atmosphere opening before the inner space of the sub tank is opened to the atmosphere via the liquid inlet.

6. The liquid ejection device according to claim 1, wherein the valve opens the atmosphere opening after the main tank is connected via the liquid inlet.

7. The liquid ejection device according to claim 1, wherein when the main tank is not connected to the sub tank, the liquid inlet opens to the outside of the sub tank.

8. The liquid ejection device according to claim 1, wherein the valve comprises a valve body configured to move between an open position to open the atmosphere opening and a close position to close the atmosphere opening, wherein, when the main tank is connected to the connection portion, the valve body contacts with a part of the main tank and moves to the open position.

9. The liquid ejection device according to claim 8, wherein the valve further comprises an urging member configured to urge the valve body toward the close position.

10. The liquid ejection device according to claim 1, further comprising:

a connection detecting unit configured to detect whether the main tank is connected to the connection portion; and a valve control unit configured to open the valve based on a detection result indicating that the main tank is connected to the connection portion, and close the valve open based on a detection result indicating that the main tank is not connected to the connection portion.

11. The liquid ejection device according to claim 10, wherein the valve comprises a solenoid valve.

12. The liquid ejection device according to claim 1, wherein the sub tank comprises:

a liquid outlet connected to the liquid ejection head;

a partition portion that partitions the inner space of the sub tank into an upper chamber and a lower chamber and has a communication portion positioned above the liquid outlet and allow a fluid communication between the upper chamber and the lower chamber; and an open/close member configured to open and close the communication portion depending on liquid level in the inner space of the sub tank.

13. The liquid ejection device according to claim 12, wherein the open/close member comprises a float disposed in the upper chamber and having a smaller specific gravity than the liquid.

14. The liquid ejection device according to claim 1, wherein the main tank comprises a pin configured to press the valve to open the atmosphere opening when the main tank is connected to the connection portion.

15. The liquid ejection device according to claim 1, wherein the main tank comprises an atmosphere opening and an atmospheric release valve configured to selectively open the atmosphere opening of the main tank.

16. A sub tank for use with a liquid ejection device comprising an ejection head and connectable to a main tank to supply the liquid contained in the main tank to the liquid ejection device, said sub tank comprising:

an inner space defined in the sub tank;

a connection portion configured to connect the inner space with the main tank;

a liquid inlet through which the liquid is allowed to flow from the main tank into the inner space when the main tank is connected to the connection portion;

an atmosphere opening that communicates between an outside of the sub tank and the inner space; and a valve configured to selectively open and close the atmosphere opening, wherein the valve opens the atmosphere opening in a state where the main tank is connected to the connection portion and closes the atmosphere opening in a state where the main tank is not connected to the connection portion.

* * * * *